US008413816B2

(12) United States Patent
Child

(10) Patent No.: US 8,413,816 B2
(45) Date of Patent: Apr. 9, 2013

(54) SULFIDE FLOTATION AID

(75) Inventor: Daniel E. Child, Alta Loma, CA (US)

(73) Assignee: Nalco Company, Naperville, IL (US)

( * ) Notice: Subject to any disclaimer, the term of this patent is extended or adjusted under 35 U.S.C. 154(b) by 695 days.

(21) Appl. No.: 12/706,091

(22) Filed: Feb. 16, 2010

(65) Prior Publication Data

US 2011/0198296 A1 Aug. 18, 2011

(51) Int. Cl.
*B03D 1/014* (2006.01)
*B03D 1/02* (2006.01)
*B03D 1/016* (2006.01)

(52) U.S. Cl.
USPC ..... 209/166; 209/167

(58) Field of Classification Search ..... 209/166, 209/167
See application file for complete search history.

(56) References Cited

U.S. PATENT DOCUMENTS

| | | | | |
|---|---|---|---|---|
| 745,546 | A | 11/1903 | Wheelwright | |
| 1,153,054 | A | 9/1915 | Frary | |
| 1,414,837 | A | 5/1924 | Stark | |
| 1,833,427 | A | 11/1931 | Lavers et al. | |
| 1,852,959 | A | 4/1932 | Dutoit | |
| 1,869,532 | A | 8/1932 | Weinig | |
| 2,255,776 | A | 9/1941 | Janney | |
| 2,492,936 | A | 12/1949 | Nokes et al. | |
| 2,559,104 | A | 7/1951 | Arbiter | |
| 3,102,854 | A | 9/1963 | Atwood | |
| 3,137,649 | A | 6/1964 | DeBenedictis | |
| 3,539,002 | A | 11/1970 | Last | |
| 3,811,569 | A | 5/1974 | Shirley | |
| 4,329,223 | A | 5/1982 | Ramadorai et al. | |
| 4,549,959 | A | 10/1985 | Armstrong et al. | |
| 5,068,028 | A | 11/1991 | Miller et al. | |
| 5,368,830 | A | 11/1994 | Alfano et al. | |
| 5,454,954 | A | 10/1995 | Alfano et al. | |
| 6,536,595 | B2 * | 3/2003 | Kowalski et al. | 209/166 |
| 6,827,220 | B1 | 12/2004 | Young et al. | |
| 7,553,984 | B2 | 6/2009 | Rau et al. | |

FOREIGN PATENT DOCUMENTS

| | | | |
|---|---|---|---|
| CA | 1070034 | | 1/1980 |
| GB | 2156819 | A | 10/1985 |
| RU | 2057595 | * | 4/1996 |
| SU | 650657 | * | 5/1979 |
| SU | 1176955 | * | 7/1985 |
| WO | 87/00088 | | 1/1987 |

OTHER PUBLICATIONS

Connor, C. T. and Dunne, R. C., "The Flotation of Gold Bearing Ores—A Review," *Minerals Engineering*, vol. 7, No. 7,1994, pp. 839-849.

Klimpel, R. R., "Industrial experiences in the evaluation of various flotation reagent schemes for the recovery of gold," *Minerals & Metallurgical Processing*, vol. 16, No. 1, 1999, pp. 1-14.

Marsden, J. and House, C. I., *The Chemistry of Gold Extraction*, 2nd Edition, SME, Inc., 2006, pp. 409-447.

Wills, B. A., *Mineral Processing Technology*, 6th Edition, Butterworth Heinemann, 2003, pp 258-272.

* cited by examiner

*Primary Examiner* — Thomas M Lithgow
(74) *Attorney, Agent, or Firm* — Benjamin E. Carlsen; Calfee, Halter & Griswold LLP

(57) ABSTRACT

The invention provides a method of improving a flotation separation process. The method involves PAPEMP, a material previously thought to only be of use in controlling scale deposit on surfaces of equipment used in cyanide leaching. In the invention the PAPEMP is added to the flotation separation process for improved sulfide mineral separation. Not only does the addition of PAPEMP improve the overall recovery of sulfide complexed metals in flotation, but by doing so it also reduces the energy requirements and adds other efficiencies to other downstream ore processing and refining steps. This has the added benefit of helping to preserve the environment.

15 Claims, No Drawings

SULFIDE FLOTATION AID

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to methods compositions, and apparatuses for improving the effectiveness of froth flotation separation processes. Froth flotation separation is a technique commonly used in the mining industry for separating various mineral constituents from ores. Examples of this method are described in U.S. Pat. No. 6,827,220, in textbook chapters: 12 *of Mineral Processing Technology,* 6th Edition, by Barry A. Wills, (Published by Butterworth Heinemann), (2003) and 9 of *The Chemistry of Gold Extraction,* 2nd Edition, by John Marsden and C. Iain House, (Published by SME), (2006), and in the scientific papers: *Industrial experiences in the evaluation of various flotation reagent schemes for the recovery of gold*, by R. R. Klimpel, Minerals & Metallurgical Processing, Vol. 16 No. 1 (1999) and *The Flotation of Gold Bearing Ores—A Review*, by C. T. Connor and R. C. Dunne, Minerals Engineering, Vol. 7 No. 7 (1994).

In preparation for flotation, the ore is comminuted (ground up by such techniques as dry-grinding, wet-grinding, and the like) and then dispersed in water to form a suspension known as pulp. Additives such as collectors are normally added to the ore bearing suspension, frequently in conjunction with frothers and optionally other auxiliary reagents such as regulators, depressors (deactivators) and/or activators, in order to enhance the selectivity of the flotation step and facilitate the separation of the valuable mineral constituent(s) from the unwanted gangue constituents. The pulp is conditioned by these reagents for a period of time before a gas, typically air, is sparged into the suspension to produce bubbles of the gas. Minerals that adhere to the bubbles as they rise to the surface are thereby concentrated in the froth that accumulates at the surface of the aerated pulp. The mineral-bearing froth is skimmed or otherwise removed from the surface and processed further to obtain the desired minerals.

The beneficiation of ores by froth flotation utilizes differences in hydrophobicity of various components of a suspension, and these differences in hydrobphobicity may be increased or decreased by judicious choice of chemical additives. In one form, the collector is a hydrophobic agent, which is selectively engaged to the surface of a particular ore constituent and increases the hydrophobicity of the mineral. Gas bubbles admitted during the aeration step will preferentially adhere to the hydrophobicized mineral constituent. Because the mineral components have been treated or modified with the collector, they exhibit sufficiently increased hydrophobicity to be more readily removed from the aerated pulp by the bubbles than are other constituents which are less hydrophobic or hydrophilic. As a result, the collector efficiently pulls the particular ore constituent out of the aqueous solution while the remaining constituents of the ore, which are not modified by the collector, remain suspended in the aqueous phase. This process can also or instead utilize chemicals, which increase the hydrophilic properties of materials selected to remain suspended within the aqueous phase.

In direct flotation processes, the desired mineral which is concentrated and enriched in the froth at the surface of the flotation cell is referred to as the concentrate. The portion of the suspension that does not float is comprised predominantly of gangue minerals of the ore and is referred to as the tails. These tails are often discarded as mine tailings. In reverse flotation processes, the gangue constituent is floated into the concentrate and the desired constituent remains suspended in the slurry. In either type of flotation process, the object of the flotation is to separate and recover as much of the valuable mineral constituent(s) of the ore as possible in as high a concentration as possible which is then made available for further downstream processing steps such as thickening, filtration, and roasting.

A number of materials are known to be useful in facilitating froth flotation separation processes. Collectors based on fatty acids have long been used in collecting one or more of the oxide minerals such as fluorspar, iron, chromite, scheelite, $CaCO_3$, Mg $CO_3$, apatite, or ilmenite. Neutralized fatty acids are soaps that have been shown to operate as non-selective flotation collectors. Petroleum-based oily compounds such as diesel fuels, decant oils, and light cycle oils, are often used to float molybdenite.

Of particular interest to the mining industry are collectors especially effective at selectively floating sulfide mineral ore constituents which comprise complexes with valuable metals including gold, silver, copper, lead, zinc, molybdenum, nickel, platinum, palladium, and other metals. U.S. Pat. No. 7,553,984 teaches that organic molecules containing sulfur are useful compounds for the froth flotation of sulfide minerals.

Organic compounds containing sulfur, such as xanthates, xanthogen formates, thionocarbamates, dithiophosphates, and mercaptans, will selectively collect one or more sulfide minerals such as chalcocite, chalcopyrite, galena, or sphalerite. Such sulfur-based collectors are usually grouped into two categories: water-soluble and oily (i.e., hydrophobic) collectors. Water-soluble collectors such as xanthates, sodium salts of dithiophosphates, and mercaptobenzothiazole have good solubility in water (at least 50 gram per liter) and very little solubility in alkanes. Oily collectors, such as zinc salts of dithiophosphates, thionocarbamates, mercaptans, xanthogen formates, and ethyl octylsulfide, have negligible solubility in water and generally good solubility in alkanes.

Currently used collectors for most sulfide minerals are sulfur-based chemicals such as xanthates, xanthogen formates, thionocarbamates, dithiophosphates, or mercaptans. All of these prior art methods however do not provide optimal recovery rates of the desired minerals and thus there remains a need for improved methods, compositions, and apparatuses for the selective flotation collection of sulfide minerals.

BRIEF SUMMARY OF THE INVENTION

At least one embodiment of the invention is directed towards a method of improving the removal of a particular material from a comminuted sulfide mineral ore by a flotation separation process. The method comprises the steps of: providing an aqueous suspension of the comminuted ore, adding a effective amount of PAPEMP to the suspension, affording the PAPEMP sufficient residence time in the suspension, selectively floating the particular material by sparging the suspension to form a concentrate and a slurry, and recovering the particular material as either concentrate or slurry.

The flotation process can be a normal flotation process in which the desired material forms a concentrate at the top of the suspension. The method can further comprising the step of adding a frother, a collector, lead nitrate, copper sulfate, and any combination thereof to the suspension. The particular material can be a precious metal or a base metal selected from the list consisting of: gold, silver, copper, lead, zinc, molybdenum, nickel, platinum, palladium, and any combination thereof. The method can occur within a metal refining operation in which the addition of the PAPEMP during the flotation separation process increases the yield of the refined metal by a range of between 1-70% when all other steps in the refining process are controlled for.

DETAILED DESCRIPTION OF THE INVENTION

For purposes of this application the definition of these terms is as follows:

"Base metal" means a valuable metal selected from the list consisting of copper, lead, zinc, molybdenum, nickel, and any combination thereof.

"Collector" means a composition of matter that selectively adheres to a particular ore constituent and facilitates the adhesion of the particular ore constituent to the micro-bubbles that result from the sparging of an ore bearing aqueous suspension.

"Comminuted" means powdered, pulverized, ground, or otherwise rendered into fine particles.

"Concentrate" means the portion of a comminuted ore which is separated by flotation and collected within the froth.

"Frother" means a composition of matter that enhances the formation of the micro-bubbles and/or preserves the formed micro-bubbles bearing the fine hydrophobic mineral fraction that results from the sparging of an ore bearing aqueous suspension.

"PAX" means potassium amyl xanthate.

"PAPEMP" means a polyamino methylene phosphonate that is:

a) of the formula:

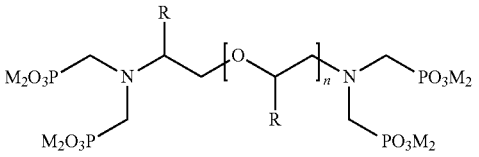

where n is an integer or fractional integer which is, or on average is, from about 2 to about 12, inclusive; M is hydrogen or a suitable cation; and each R may be the same or different and is independently selected from hydrogen and methyl, a preferred subclass of compositions of the above formula is that wherein M is hydrogen, R is methyl, and n is from about 2 to about 3, most preferably an average of about 2.6, and/or b) one or more of the molecules structurally related to the above polyamino methylene phosphonate that are described in U.S. Pat. No. 5,368,830 as useful in scale control.

"Precious metal" means a valuable metal selected from the list consisting of to gold, silver, platinum, palladium, and any combination thereof.

"Supplemental Flotation" means at least one additional froth flotation separation process performed on an ore containing more than one desired material, which is performed after at least some of the gangue constituent has been substantially removed from the ore material by a previous froth flotation separation process, and is performed to separate is at least one of the desired ore materials from another.

"Slurry" means the portion of a medium that contained comminuted ore that has undergone gas sparging that is below the concentrate.

"Sparging" means the introduction of gas into a liquid for the purpose of creating a plurality of bubbles that migrate up the liquid.

"Sulfide mineral ore" means an ore comprising at least one metal which forms a complex comprising a covalently bonded crystal structure between the metal and sulfur ions, it includes but is not limited to pyrite, arsenopyrite, pyrrhotite, stilbnite, chalcopyrite, bornite, chalcocite, covellite, galena, sphalerite, molybdenite, the metal includes but is not limited to base metals and precious metals.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Othmer Encyclopedia of Chemical Technology,* 5th Edition, (2005), (Published by Wiley, John & Sons, Inc.) this definition shall control how the term is to be defined in the claims.

At least one embodiment of the invention is a method of separating a desired material from a comminuted sulfide mineral ore. The method comprising the steps of: providing an aqueous suspension of the comminuted ore, adding an effective amount of PAPEMP to the suspension, affording the PAPEMP sufficient residence time in the suspension, selectively floating materials by sparging the suspension to form a concentrate and a slurry, and recovering the desired material from the appropriate suspension layer.

In at least one embodiment the flotation process is a direct flotation process and the desired material forms a concentrate at the top of the suspension. In at least one embodiment, the process further involves adding a frother to the suspension. In at least one of the embodiments, the frother contains alcohol. In at least one embodiment a collector is also added to the suspension. In at least one embodiment the collector is PAX. In at least one embodiment, the flotation process further comprises adding lead nitrate, copper sulfate, and any combination thereof to the suspension.

In at least one embodiment, the ore contains a valuable metal, which can be but is not limited to a precious metal and/or a base metal. In at least one embodiment the valuable metal is selected from the list consisting of: gold, silver, copper, lead, zinc, molybdenum, nickel, platinum, palladium, and any combination thereof.

While the use of some forms of PAPEMP in ore processing is not new, its clear effectiveness as a sulfide mineral flotation aid is an unexpected result. U.S. Pat. Nos. 5,368,830 and 5,454,954 describes the use of PAPEMP in gold cyanide leaching solutions. Specifically they discuss the use of PAPEMP in preventing the formation of calcium bearing scale on equipment used during gold cyanide leaching processes. Cyanide leaching or cyanidation, is a process in which gold bearing ore is dissolved in cyanide to separate it from other constituents of the ore.

The use of PAPEMP as a flotation aid is quite different than these prior uses because when used, PAPEMP has previously only been used for mineral processing stages that occur at different times and under different conditions from flotation separation. Most metals that undergo froth flotation have not been subjected to a prior cyanidation step. In the context of gold or silver bearing ore, in an overwhelming number of situations if there is a cyanidation step it is conducted only after steps subsequent to flotation separation where the sulfides have been removed or reduced by further processing such as roasting or autoclaving. This is because the sulfides interfere with cyanidation and their removal improves the subsequent cyanidation step. Rarely does a cyanidation step occur before a flotation step. The cyanidation step however is never simultaneous to the flotation separation because the physical requirements of a cyanidation step are contradictory to those involved in flotation separation.

In addition, the purpose and use of PAPEMP in this invention is completely different than its use in the Prior Art. In the Prior Art, PAPEMP is used to prevent the deposition of calcium bearing scale onto process equipment surfaces, which if left untreated, could result in equipment blockage and fouling. In contrast this invention uses PAPEMP not to protect equipment, but to enhance flotation selectivity as well as overall desired metal yield. In at least one embodiment the PAPEMP is added to a flotation separation process, to which is not prone to calcium bearing scale deposition.

In at least one embodiment instead of or in addition to PAPEMP, one of the polycarboxylate polymers and/or copolymers described in US Published Patent Application 2009/0294372 is used.

Without being limited by theory to the construal of the claims, it is believed that the PAPEMP enhances the flotation separation process by preventing the adhesion of ore constituents and process additives such as calcium bearing materials and magnesium bearing materials and in particular calcium sulfate, calcium carbonate, clays, silicates, and any combination thereof, to the metal sulfide and thereby allows a greater amount of collector to bind to the metal sulfide. More bindings between the metal sulfide and the collector results in the micro-bubbles pulling a greater amount of metal sulfide out of the slurry.

In at least one embodiment, the PAPEMP is added to an ore bearing suspension before the collector is added. In at least one embodiment, the PAPEMP is afforded sufficient residence time to clear off other ore constituents and process additives from metal sulfide particles before the collector is added to the suspension. In at least one embodiment, the PAPEMP reduces the amount of clay that is removed by the flotation process. In at least one embodiment, the PAPEMP increases the purity of the removed metal sulfide.

In at least one embodiment the PAPEMP is introduced in a composition comprising 1-40% water, 1-40% PAPEMP, and 1-40% of a polymer and/or copolymer of acrylic acid. In at least one embodiment the PAPEMP is added to a supplemental flotation step. In at least one embodiment the PAPEMP is added to a supplemental flotation step described in U.S. Pat. Nos. 5,068,028, 4,549,959, 2,492,936, and the references cited therein. In at least one embodiment the supplemental flotation step separates molybdenite from copper bearing ores. In at least one embodiment a depressant is used on at least one desired material to retain it in the slurry. In at least one embodiment calcium is also added to the supplemental flotation step.

Examples

The foregoing may be better understood by reference to the following example, which is presented for purposes of illustration and is not intended to limit the scope of the invention.

A flotation circuit to process high carbonate pyritic gold-bearing ore was prepared. The ore was finely ground so that 70% of the ore mass could be passed through a 325 mesh standard sieve. The ground ore mass was suspended in a slurry to afford approximately 25% solids by weight. Sulfuric acid was added to reduce the pH to approximately 5.5. PAPEMP (in amounts ranging from 3-7 ppm) as well as an alcohol frother and PAX collector were added to the suspension. The suspension was sparged and the concentrate was removed for further processing.

Analysis indicated that the concentrate comprised 85-87% recovery of the total gold mass. Similar experiments conducted on the same facility with the same ore but which were lacking the added PAPEMP only recovered 55-60% of the gold mass. The increased yield and purity resulted in downstream ore processing steps to increase productivity by as much as 50% without any other changes in the ore refining steps.

Furthermore, the addition of PAPEMP reduced the energy required in the downstream roasting step. Roasting is a process in which carbonaceous material is removed from the desired metal material by heating it. In roasting, the oxidation of sulfides into sulfates adds energy to the heating process. The higher sulfide content of the more pure floated metal sulfides provided more energy to the roasting process.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of improving the removal of a particular material from a comminuted sulfide mineral ore by a flotation separation process, the method comprising the steps of:

providing an aqueous suspension of the comminuted ore, adding an effective amount of PAPEMP to the suspension, affording the PAPEMP sufficient residence time in the suspension, selectively floating the particular material by sparging the suspension to form a concentrate and a slurry, and recovering the particular material from the appropriate concentrate or slurry.

2. The method of claim 1 in which the flotation process is a portion of an overall ore refining process, and if the ore refining process comprises a cyanidation process, the flotation process occurs prior to the cyanidation process.

3. The method of claim 1 in which the flotation process is a portion of an overall ore refining process that does not include a cyanidation process.

4. The method of claim 1 further comprising the step of adding a frother to the suspension.

5. The method of claim 1 further comprising the step of adding a collector to the suspension.

6. The method of claim 1 further comprising the step of adding lead nitrate, copper sulfate, and any combination thereof to the suspension.

7. The method of claim 1 in which the particular material is a precious or base metal selected from the list consisting of: gold, silver, copper, lead, zinc, molybdenum, nickel, platinum, palladium, and any combination thereof.

8. The method of claim 1 in which the PAPEMP is added to a flotation separation process not prone to calcium sulfate deposition.

9. The method of claim 1 in which the PAPEMP is added to an ore bearing suspension before a collector is added and the PAPEMP is afforded sufficient residence time to facilitate clearing off other ore constituents from metal sulfide particles before the collector is added to the suspension.

10. The method of claim 1 which occurs within a metal refining operation in which the addition of the PAPEMP during the flotation separation process increases the recovery of the total metal in the ore by a range of between 1-80% when all other steps in the refining process are controlled for.

11. The method of claim 1 in which the added PAPEMP is in a dosage of at least 0.5 ppm.

12. The method of claim 1 in which the added PAPEMP is added while in a composition comprising 1-40% water, 1-40% PAPEMP, and 1-40% of a polymer and/or copolymer of acrylic acid.

13. The method of claim 1 in which the added PAPEMP reduces the energy needed to roast the particular material when compared to a similar method of removal lacking the added PAPEMP.

14. The method of claim 1 in which the added PAPEMP increases the selectivity of which specific ore constituents are floated by the flotation separation process.

15. The method of claim 1 in which the flotation process is a direct flotation process and the desired material forms a concentrate at the top of the suspension.

* * * * *